US011952871B1

(12) United States Patent
Al-Dakheel et al.

(10) Patent No.: US 11,952,871 B1
(45) Date of Patent: Apr. 9, 2024

(54) METHODS AND SYSTEMS FOR STIMULATION OF A SUBTERRANEAN FORMATION USING AT LEAST ONE SELF-RESONATING NOZZLE

(71) Applicant: Schlumberger Technology Corporation, Sugar Land, TX (US)

(72) Inventors: Hussain Khalifah Al-Dakheel, Dhahran (SA); Mustapha Abbad, Al-Khobar (SA); Gallyam Aidagulov, Doha (SA)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/163,992

(22) Filed: Feb. 3, 2023

(51) Int. Cl.
*E21B 43/114* (2006.01)
*E21B 43/26* (2006.01)
*F15D 1/08* (2006.01)

(52) U.S. Cl.
CPC ..... *E21B 43/114* (2013.01); *E21B 43/26* (2013.01)

(58) Field of Classification Search
CPC .. E21B 43/114; E21B 10/61; Y10T 137/2185; B05B 1/08; F15C 1/22; B26F 3/004; B26F 1/26; F15D 1/08
See application file for complete search history.

(56) References Cited

U.S. PATENT DOCUMENTS 4,474,251 A * 10/1984 Johnson, Jr. ..... B26F 3/004 239/102.1
5,495,903 A * 3/1996 Griffin ..... E21B 7/24 239/589.1
6,470,980 B1 * 10/2002 Dodd ..... E21B 10/60 175/393
7,350,567 B2 * 4/2008 Stolarczyk ..... E21B 43/003 166/177.2
9,227,204 B2 * 1/2016 Surjaatmadja ..... E21B 41/0078
10,550,668 B2 * 2/2020 Resendez ..... E21B 37/00

OTHER PUBLICATIONS

Tripathi, R. et al., "Application of the pulsating and continuous water jet for granite erosion", International Journal of Rock Mechanics and Mining Sciences, 2020, 126, 104209, 11 pages.

* cited by examiner

*Primary Examiner* — Kenneth L Thompson
(74) *Attorney, Agent, or Firm* — Jeffrey D. Frantz

(57) ABSTRACT

Methods and equipment are provided for stimulating recovery of hydrocarbons from a subterranean formation traversed by a wellbore, which employ at least one self-resonating nozzle. Fluid under pressure is supplied to the at least one self-resonating nozzle to create a channel in a surface of the subterranean formation facing the at least one self-resonating nozzle. In embodiments, the equipment can be a downhole tool or completion equipment (such as a liner) that is deployed in the wellbore.

29 Claims, 9 Drawing Sheets

METHODS AND SYSTEMS FOR STIMULATION OF A SUBTERRANEAN FORMATION USING AT LEAST ONE SELF-RESONATING NOZZLE

FIELD

The present disclosure relates to stimulation of a subterranean formation to increase production of formation fluid trapped in the formation.

BACKGROUND

The rate of recovery of fluids from hydrocarbon-bearing subterranean formations (i.e., subterranean hydrocarbon reservoirs) is governed by the interplay of viscous and capillary forces that determine fluid transport in porous media, and several enhanced recovery techniques have been devised to increase the rate and completeness of fluid transport.

One type of enhanced recovery technique is commonly referred to as fracture stimulation or hydraulic fracturing. Fracture stimulation can provide for effective fluid communication between a wellbore and a subterranean formation that holds formation fluid trapped in the formation. Fracture stimulation injects fluid, which is typically referred to as "frac fluid," under high pressure into the formation to break formation rock and create fractures in the rock that are fluidly coupled to the wellbore. As a result of such fluid communication, the production rate of the formation fluids from the formation into the wellbore can be increased significantly.

However, fracture stimulation faces numerous challenges. For example, if poorly located or contained, the created fracture can enhance production of water in non-hydrocarbon zones, which can lead to an undesired mixture and lower hydrocarbon production. In another example, the initiated fractures can intervene by the stress shadow effect resulting in fracture retardation. Hence, controlling fracture location is necessary to ensure stimulating the targeted zones without causing interferences. In yet another example, reaching the fracture breakdown pressure for the fracture stimulation can be difficult for the utilized well completion or surface pumping equipment, particularly for tight formations. To address this challenge, weak points can be created in formation rock in the stimulation zone prior to the fracture stimulation. The weak points can be perforations in the open hole wall, or longitudinally or transversely cut notches in the open hole wall (including 360° "circular" notches cut along the complete circumference of the open hole wall). At these weak points, a fracture has a preference to initiate and propagate at lower pressure due to the high tensile stress concentrations developed in desired directions. In this manner, the creation of the weak points in the targeted stimulation zone allows for the fracture breakdown pressure to be reduced for subsequent fracture stimulation of the stimulation zone.

In the current fracture stimulation operations, the weak points are created by either conventional water jetting, or abrasive jetting (e.g., SLB AbrasiFRAC®). In the case of conventional water jetting, water is supplied to downhole nozzles at high pressure. Despite high pressure differential and velocity at the nozzles, cavitation of water jets produced by the nozzles is suppressed by downhole pressure, which significantly reduces the eroding capability of the water jets in forming the weak points. In the case of abrasive jetting, a slurry containing abrasive solids is supplied at high differential pressures to a specially designed downhole jet gun. The resulting high-velocity fluid stream perforates tubulars (casing, liner, predrilled or slotted liner, and tubing) and any surrounding cement, and then penetrates deep into the formation. While abrasive jetting has been implemented successfully in vertical wells, it has encountered challenges in horizontal wells. Specially, in a horizontal well, sand particles of the high-velocity fluid stream can accumulate around the jet gun leading to wellbore clogging and pipe stuck.

Another type of enhanced recovery technique is commonly referred to as matrix stimulation, which uses injecting specially-designed chemicals (e.g., acid) into the well that react with the formation rock to dissolve the rock and create channels or wormholes in the formation to enhance communication between the wellbore and the reservoir. Matrix stimulation provides advantages of gaining high production rate to the field operators. However, it faces challenges in term of efficiency and accuracy. For instance, acid stimulation by bullheading can lead to overstimulation of high permeable zones leaving low permeable zones unstimulated. Hence, the need for diversion methods rises to control acid placement. One technique is acid jetting which is performed by impinging acid at high velocity on the formation face to create channels or wormholes in the formation. By doing so, the acid is ensured to be fed evenly. In addition, the high jetting velocity contributes to more effective wormhole growth as it can boost depth of penetration of the acid into the formation.

In the current matrix stimulation operations, nozzles are placed in the BHA to increase the velocity of the jetted acid. However, these conventional nozzles require high power to produce the targeted jetting velocities. Based on the previous studies, jetting velocity can influence both the cavity (an initial erosion in the formation rock) and the wormhole growth in the formation.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In an embodiment, a method is provided for stimulating recovery of hydrocarbons from a subterranean formation traversed by a wellbore, which involves deploying equipment in the wellbore. The equipment includes at least one self-resonating nozzle. Fluid under pressure is supplied to the at least one self-resonating nozzle to create a channel in a surface of the subterranean formation facing the at least one self-resonating nozzle.

In embodiments, the equipment can be a downhole tool that is deployed in the wellbore.

In other embodiments, the equipment can be completion equipment, such as a liner, that is deployed in the wellbore.

In embodiments, the fluid supplied to the at least one self-resonating nozzle can be aqueous fluid or other type of non-abrasive fluid optimized for compatibility with the treated formation.

In embodiments, the aqueous fluid can be ground water, water extracted from a river or lake or other body of water, seawater or brackish water, the output of desalinization plant, or other water-based fluid.

In embodiments the aqueous fluid can be filtered or otherwise selected such that it contains a desired minimal amount of abrasive particulate matter.

In other embodiments, the fluid supplied to the at least one self-resonating nozzle can be a chemical composition (e.g., acid) that dissolves formation rock.

In embodiments, the self-resonating nozzle can include a resonant cavity formed upstream of a nozzle orifice, wherein the fluid under pressure is configured to flow into the resonant cavity of the self-resonating nozzle.

In embodiments, dimensions and geometry of the resonant cavity and nozzle orifice can be configured to provide internal self-excited resonant oscillation of acoustic waves of specific frequencies formed by fluid flow through the resonant cavity and out the nozzle orifice. The self-excited resonant oscillation can produce a jet of oscillating fluid velocity that is output from the nozzle orifice. The oscillating fluid velocity of the jet can form high frequency pressure pulses that impact a surface of the subterranean formation that faces the nozzle orifice to create the channel in the subterranean formation.

In embodiments, the equipment can include an array of self-resonating nozzles configured to create channels in surfaces of the subterranean formation facing the array of self-resonating nozzles.

In embodiments, the at least one self-resonating nozzle can be supported on a downhole tool or completion equipment that is positioned in a stable location and orientated in the wellbore as the pressurized fluid is supplied to the at least one self-resonating nozzle to create a channel in the formation.

In embodiments, the at least one self-resonating nozzle can be supported on a rotatable downhole tool that is deployed in the wellbore and rotated about the wellbore axis as the pressurized fluid is supplied to the downhole tool to create a circular notch in the formation.

In embodiments, the at least one self-resonating nozzle can be supported on a downhole tool that is moved in the wellbore as the pressurized fluid is supplied to the at least one self-resonating nozzle to create a linear (longitudinal) or curvilinear notch in the formation.

In embodiments, the jet output from the self-resonating nozzle forms high frequency pressure pulses that lead to efficient and effective water jetting or hydro demolition of a subterranean formation impacted by the jet.

In embodiments, the channel(s) created by the jet can form a weak point in the formation rock prior to fracture stimulation. The weak point can be a perforation in the open hole wall, or a longitudinally or transversely cut notch in the open hole wall, including a 360° "circular" notch cut along the complete circumference of the open hole wall. The perforation or notch in the open hole wall can extend in a radial direction into the formation away from the central axis of the wellbore. At such a weak point, a fracture has a preference to initiate and propagate at lower pressure due to the high tensile stress concentrations developed in a desired direction. In this manner, the creation of the weak point in the formation allows for the fracture breakdown pressure to be reduced for subsequent fracture stimulation of the formation.

In other embodiments, the jet output from the self-resonating nozzle forms high frequency pressure pulses that lead to efficient and effective acid jetting of a subterranean formation impacted by the jet.

In embodiments, the channel(s) created by the jet can form one or more wormholes that penetrate into the formation to provide tunnels in the formation that are fluidly coupled to the wellbore. The path of the wormhole(s) into the formation can be dependent on the localized solubility of the formation rock in the fluid of the jet and other parameters. The one or more wormholes can provide for fluid communication between the wellbore and the subterranean formation that holds formation fluid trapped in the formation.

Other aspects, including equipment (such as a downhole tool or completion equipment) that employ at least one self-resonating nozzle tool to create a channel in a subterranean formation, are also described and claimed.

BRIEF DESCRIPTION OF THE DRAWINGS

The subject disclosure is further described in the detailed description below, in reference to the noted plurality of drawings by way of non-limiting examples of the subject disclosure, in which like reference numerals represent similar parts throughout the several views of the following drawings; and wherein.

DETAILED DESCRIPTION

The particulars shown herein are by way of example and for purposes of illustrative discussion of the embodiments of the subject disclosure only and are presented in the cause of providing what is believed to be the most useful and readily understood description of the principles and conceptual aspects of the subject disclosure. In this regard, no attempt is made to show structural details in more detail than is necessary for the fundamental understanding of the subject disclosure, the description taken with the drawings making apparent to those skilled in the art how the several forms of the subject disclosure may be embodied in practice. Furthermore, like reference numbers and designations in the various drawings indicate like elements.

The present disclosure provides methods and systems that employ a downhole tool with at least one self-resonating nozzle that is configured to output a jet of fluid for creating one or more channels in a hydrocarbon-bearing subterranean formation.

In one embodiment, the jet output from the self-resonating nozzle forms high frequency pressure pulses that lead to efficient and effective water jetting or hydro demolition of a subterranean formation impacted by the jet. In embodiments, the channel(s) created by the jet can form a weak point in the formation prior to fracture stimulation. The weak point can be a perforation in the open hole wall, or a longitudinally or transversely cut notch in the open hole wall, including a 360° "circular" notch cut along the complete circumference of the open hole wall. The perforation or notch in the open hole wall can extend in a radial direction into the formation away from the central axis of the wellbore. At such a weak point, a fracture has a preference to initiate and propagate at lower pressure due to the high tensile stress concentrations developed in desired directions. In this manner, the creation of the weak point in the formation allows for the fracture breakdown pressure to be reduced for subsequent fracture stimulation of the formation.

In another embodiment, the jet output from the self-resonating nozzle forms high frequency pressure pulses that lead to efficient and effective acid jetting of a subterranean formation stimulated by the provided momentum. In embodiments, the channel(s) created by the jet can form one or more wormholes that penetrate into the formation to provide tunnel(s) in the rock that are fluidly coupled to the wellbore. The path of the wormhole(s) into the formation can be dependent on the localized solubility of the formation rock in the fluid of the jet and other parameters. The one or more wormholes can provide for fluid communication between the wellbore and the subterranean formation that holds formation fluid trapped in the formation.

Figure 1:
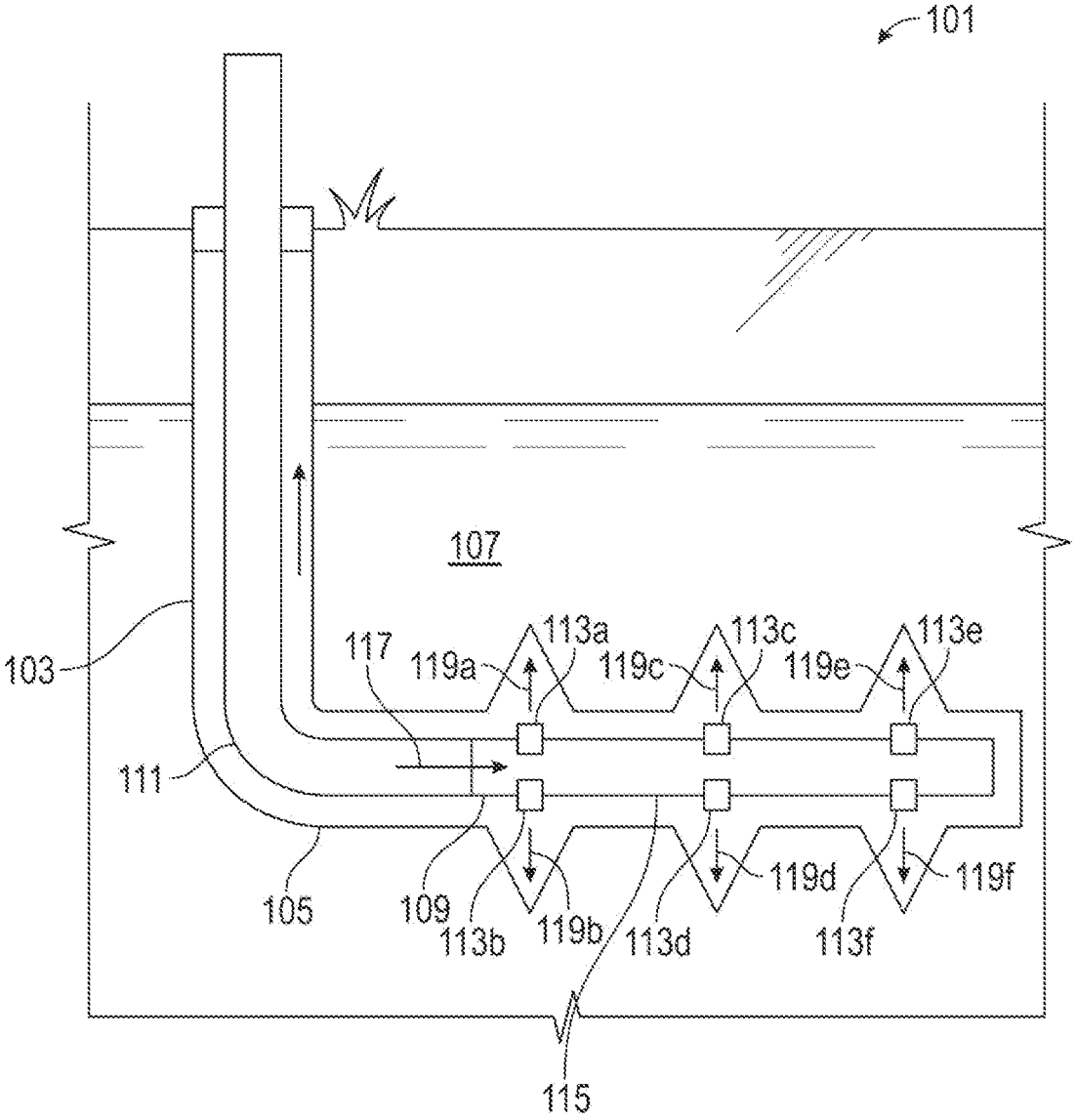
FIG. 1 is a schematic diagram of a wellsite with equipment provided for creating channels in a hydrocarbon-bearing subterranean formation by hydro demolition or water jetting.

FIG. 1 is a schematic diagram illustrating an example onshore hydrocarbon well 101 that includes a wellbore 103 with a horizontal interval 105 that traverses a hydrocarbon-bearing subterranean formation 107. In embodiments, the departure of the horizontal interval 105 from the vertical section of the wellbore 103 can exceed about 80°. Note that some horizontal wells are designed such that after reaching true 90° horizontal relative to the vertical section of the wellbore 103, the horizontal portion of the wellbore may be formed by drilling upward. The horizontal interval 105 is completed as an open hole. In the open hole completion, no casing or liner is set across the reservoir formation. A downhole tool 109 is deployed in the wellbore 103 by coiled tubing or other tubing 111. The downhole tool 109 includes an array of self-resonating nozzles (e.g., six shown as 113*a*, 113*b*, 113*c*, 113*d*, 113*e*, 113*f*) supported on an annular bottom-hole assembly (BHA) 115 wherein some self-resonating nozzles of the array are spaced axially from one another (e.g. nozzle pair 113*a*/113*b* spaced axially from nozzle pair 113*c*/113*d*, which are spaced axially from nozzle pair 113*e*/113*f*) and other self-resonating nozzles of the array are spaced angularly from one another (e.g. nozzle 113*a* is spaced angularly from nozzle 113*b*, nozzle 113*c* is spaced angularly from nozzle 113*d*, and nozzle 113*e* is spaced angularly from nozzle 113*f*, with angular spacing of 180°. Note that other angular nozzle distributions are also possible. The downhole tool 109 can be run in the wellbore 103 and positioned in the horizontal interval 105. The BHA 115 has a central channel that is in fluid communication with the interior tubular channel of the tubing 111. During operations, fluid is pumped from the surface down the tubing 111 under high pressure (below fracturing pressure) for supply to the array of nozzles as noted by arrow 117. Each self-resonating nozzle of the array includes a resonant cavity formed upstream of a nozzle orifice. The pressurized fluid flows from the central channel of the BHA 115 into the resonant cavity of each self-resonating nozzle. The dimensions and geometry of the resonant cavity and nozzle orifice of each nozzle are configured to provide internal self-excited resonant oscillation of acoustic waves of specific frequencies formed by the fluid flow through the resonant cavity and out the nozzle orifice. The self-excited resonant oscillation of the fluid produces jets of oscillating fluid velocity that is output from the nozzle orifices as noted by arrows 119*a*, 119*b*, 119*c*, 119*d*, 119*e*, 119*f*. The oscillating fluid velocity of the jets forms high frequency pressure pulses that impact the surfaces of the subterranean formation 107 that face the nozzle orifices and lead to efficient and effective erosion/hydro demolition of such formation surfaces to form channels in such surfaces as shown. In embodiments, the channels formed by the jets can be perforations or notches in the formation surfaces.

Figure 2:
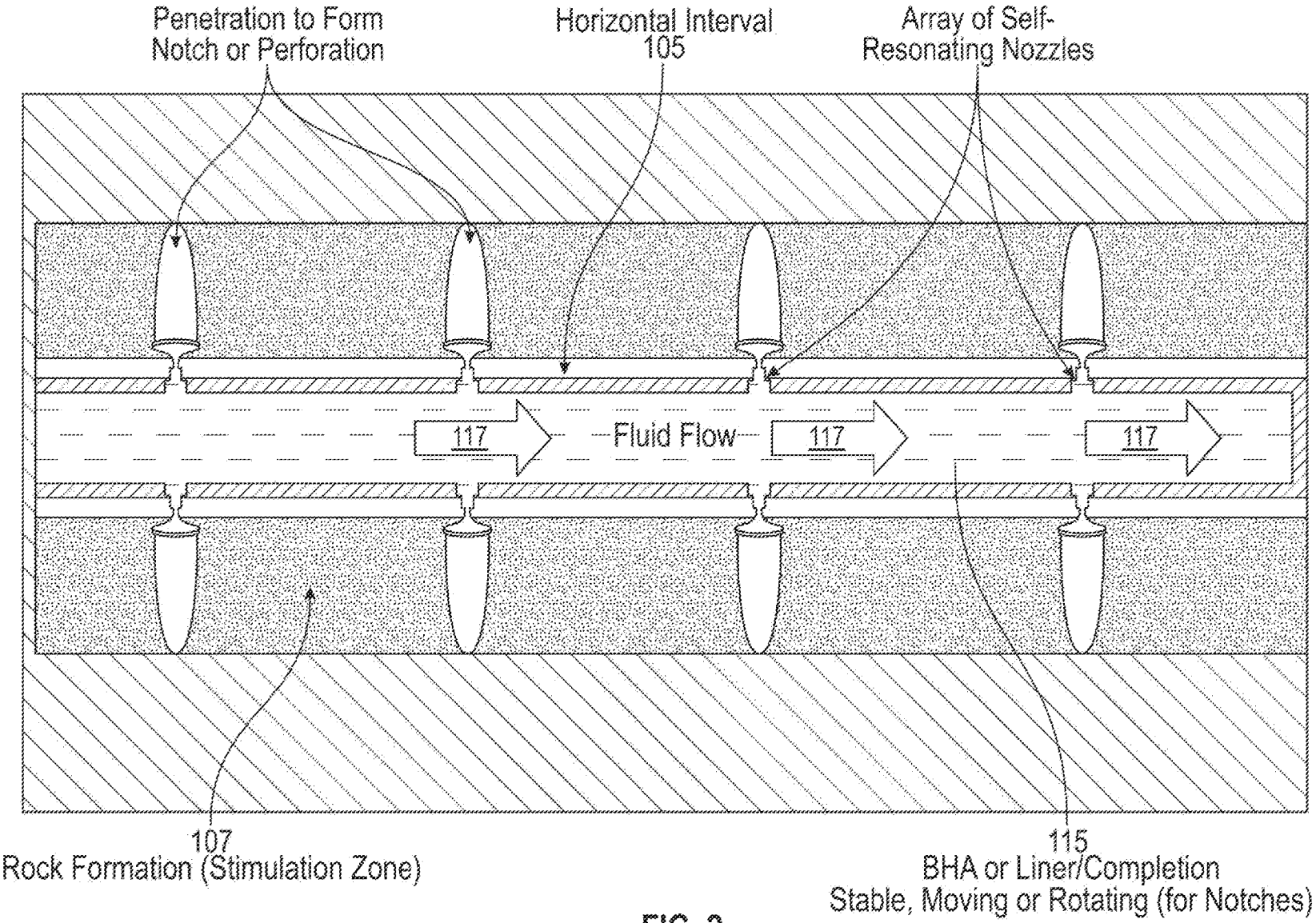
FIG. 2 is a schematic diagram of an illustrative downhole tool for creating channels (e.g., perforations or notches) in a hydrocarbon-bearing subterranean formation by hydro demolition or water jetting.

In other embodiments, an array of self-resonating nozzles can be supported on the housing of a liner (e.g., slotted liner completion, a screen and liner completions, or other non-cemented completion) or multistage completion equipment that completes the horizontal interval 105 (FIG. 2). During operations, fluid is pumped from the surface down tubing 111 under high pressure (below fracturing pressure) for supply to the array of self-resonating nozzles in a manner similar to the embodiment of FIG. 1 to create jets of fluid for creating channels in a hydrocarbon-bearing subterranean formation 107. In embodiments, the channels formed by the jets can be perforations or notches in the formation surfaces.

In one embodiment illustrated in FIG. 2, the BHA 115 is deployed in the horizontal interval 105 of the wellbore. The BHA 115 (or possibly liner/completion equipment) has a central channel that is in fluid communication with the interior tubular channel of the tubing 111. During operations, fluid is pumped from the surface down tubing 111 under high pressure for supply to the array of self-resonating nozzles as noted by arrows 117. In embodiments, the fluid can be an aqueous fluid or other type of non-abrasive fluid optimized for compatibility with the treated formation. Each self-resonating nozzle of the array includes a resonant cavity formed upstream of a nozzle orifice. The pressurized fluid flows from the central channel of the BHA 115 (or liner) into the resonant cavity of each self-resonating nozzle. The dimensions and geometry of the resonant cavity and nozzle orifice for each nozzle are configured to provide internal self-excited resonant oscillation of acoustic waves of specific frequencies formed by the flow of the fluid through the resonant cavity and out the nozzle orifice. The self-excited resonant oscillation of the fluid produces jets of oscillating fluid velocity that is output from the nozzle orifices. The oscillating fluid velocity of the jets forms high frequency pressure pulses that impact the surfaces of the subterranean formation 107 that face the nozzle orifices and lead to efficient and effective erosion/hydro demolition of such formation surfaces to form perforations or notches in such surfaces as shown. Indeed, in the prior art (Tripathi et al., "Application of the pulsating and continuous water jet for granite erosion," International Journal of Rock Mechanics and Mining Sciences, Volume 126, 2020, 104209, ISSN 1365-1609, https://doi.org/10.1016/j.ijrmms.2020.104209), pulsating water jets were shown to achieve much deeper cuts in hard rock such as granite in wide range of transverse velocities of the nozzles above the rock face and at jetting pressures significantly lower than required for continuous water jet to cause erosion. In this way, the application of self-resonating nozzles to produce perforations or notches can be a cost-effective and energy saving method, as may require smaller jetting pressure and reduce costs on maintenance and operation of high pressure pumps.

Figure 3:
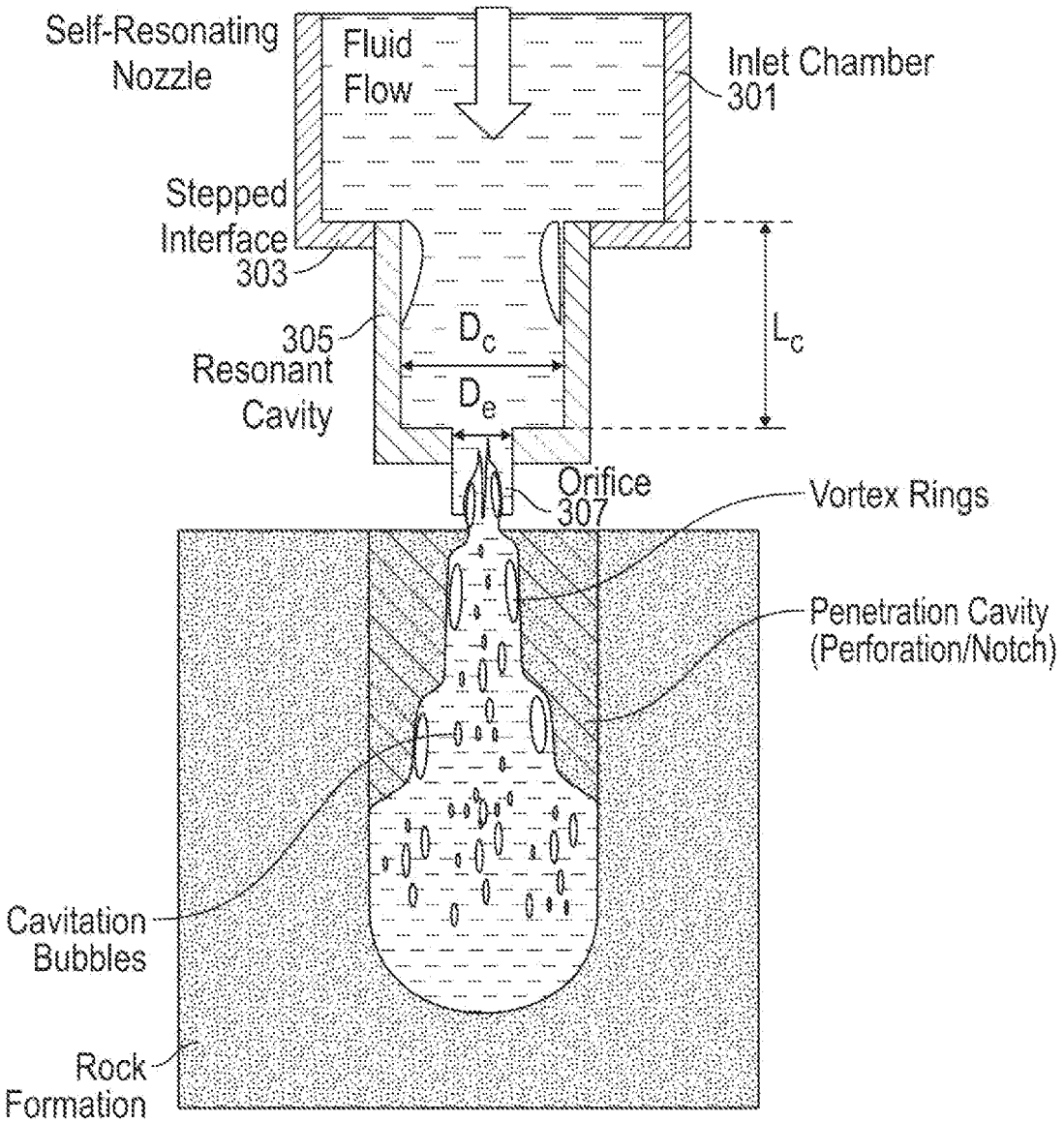
FIG. 3 is a schematic diagram of an example self-resonating nozzle that is part of the downhole tool of FIG. 2 and configured to output a jet of fluid for creating channels (e.g., perforations or notches) in a hydrocarbon-bearing subterranean formation by hydro demolition or water jetting.

FIG. 3 illustrates an embodiment of a self-resonating nozzle as described herein. In this embodiment, the self-resonating nozzle includes an inlet chamber 301, which can be in fluid communication with the central channel of the BHA 115 or a liner/completion equipment for receiving a pressurized flow of fluid as shown. The fluid can be an aqueous fluid without abrasives or other fluid without abrasives. The inlet chamber 301 extends through the self-resonating nozzle to a stepped interface (with reduced cross-sectional area) 303 that leads to a resonant cavity 305 disposed upstream of a nozzle orifice 307. The dimensions and geometry of the resonant cavity 305 and the nozzle orifice 307 are configured to provide internal self-excited resonant oscillation of acoustic waves of specific frequencies formed by the flow of the fluid through the resonant cavity 305 and out the nozzle orifice 307. The self-excited resonant oscillation of the fluid produces jets of oscillating fluid velocity that is output from the nozzle orifices. The oscillating fluid velocity of the jets forms high frequency pressure pulses that lead to efficient and effective erosion/hydro demolition of the subterranean formation impacted by the jets to form perforations or notches in the subterranean formation as shown.

As the fluid flows through the nozzle orifice 307 of the self-resonating nozzle, bubbles of the fluid vapor form. As these bubbles exit the nozzle orifice 307, they expand causing pressure magnification and fluctuation. When the bubbles impact the target surface of the formation, they collapse causing an acoustic pressure wave that is fed back to the nozzle. When the dimensions and geometry of the resonant cavity 305 and the nozzle orifice 307 are tuned to a fundamental/natural frequency, the nozzle starts resonating to produce internal self-excited resonant oscillation of acoustic waves of specific frequencies formed by the flow of the fluid through the resonant cavity 305 and out the nozzle orifice 307.

Figure 4:
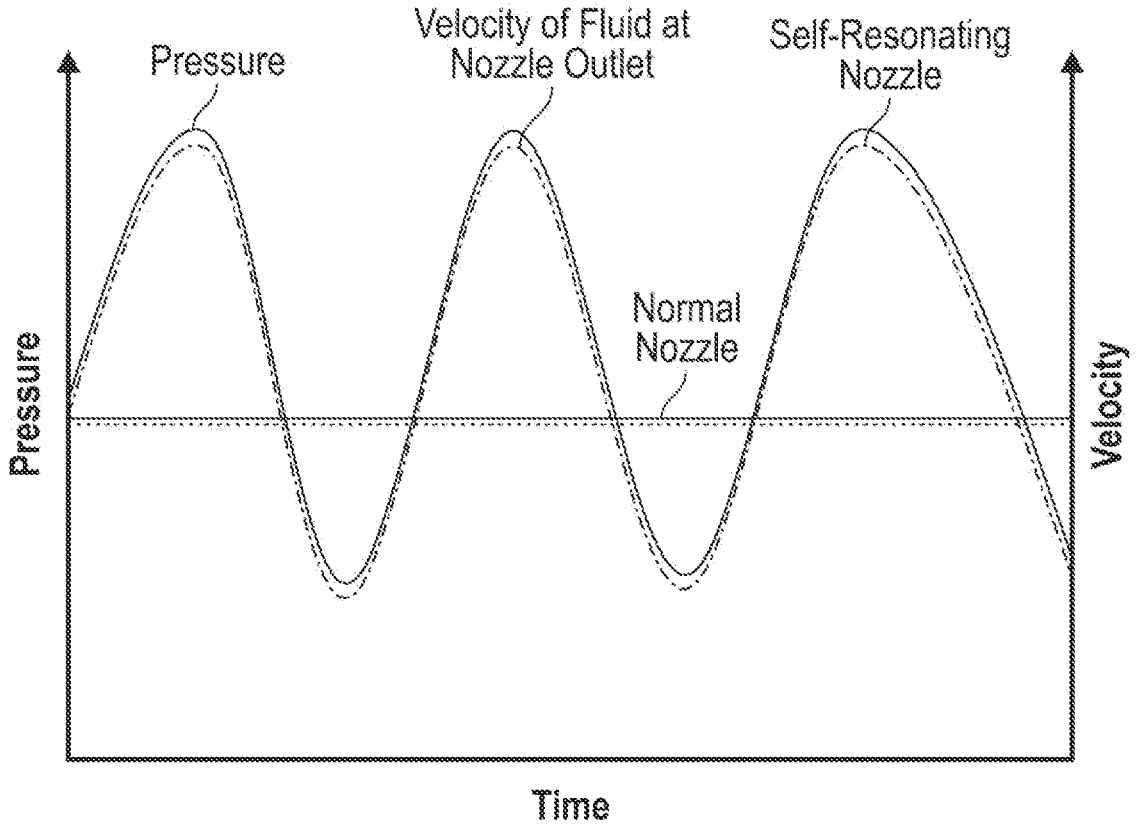
FIG. 4 is a plot of oscillating fluid velocity of a jet output by an example self-resonating nozzle for creating channels (e.g., perforations or notches) in a hydrocarbon-bearing subterranean formation. The oscillating fluid velocity of the jet forms high frequency pressure pulses that lead to efficient and effective erosion or hydro demolition of a subterranean formation impacted by the jet.

FIG. 4 is a plot of oscillating fluid velocity of a jet output by an example self-resonating nozzle for creating channels (e.g., notches or perforations) in a hydrocarbon-bearing subterranean formation. The oscillating fluid velocity of the jet forms high frequency pressure pulses that lead to efficient and effective erosion/hydro demolition of a subterranean formation impacted by the jet.

The resonance of the self-resonating nozzle is activated by controlling the pumping parameters (pressure and flowrate) according to the dimensions and geometry of the resonant cavity and the nozzle orifice. Specifically, the acoustic natural frequency is defined by the geometry of the resonant cavity by:

$$f_o = \frac{K_n c}{L_c}, \qquad \text{Eqn. (1)}$$

where $K_n$ is the wave mode number, c is the sound speed in the fluid, and $L_c$ is the length of the resonant chamber (cavity) 305, as shown in FIG. 3.

And the oscillation frequency is obtained by:

$$f_n = \frac{U_e S_d}{D_e}, \qquad \text{Eqn. (2)}$$

where $U_e$ is the jetting velocity, $S_d$ is Strouhal number, and $D_e$ is the exit diameter of the nozzle orifice 307, as shown in FIG. 3.

When the oscillation frequency approaches the acoustic natural frequency ($f_n \approx f_o$), the nozzle starts resonating to produce internal self-excited resonant oscillation of acoustical waves of specific frequencies formed by the flow of the fluid through the resonant cavity 305 and out the nozzle orifice 307. The geometric parameters can be obtained by:

$$L_c = \frac{K_n c D_e}{S_d U_e}. \qquad \text{Eqn. (3)}$$

where empirical correction factors can be included.

Figure 5:
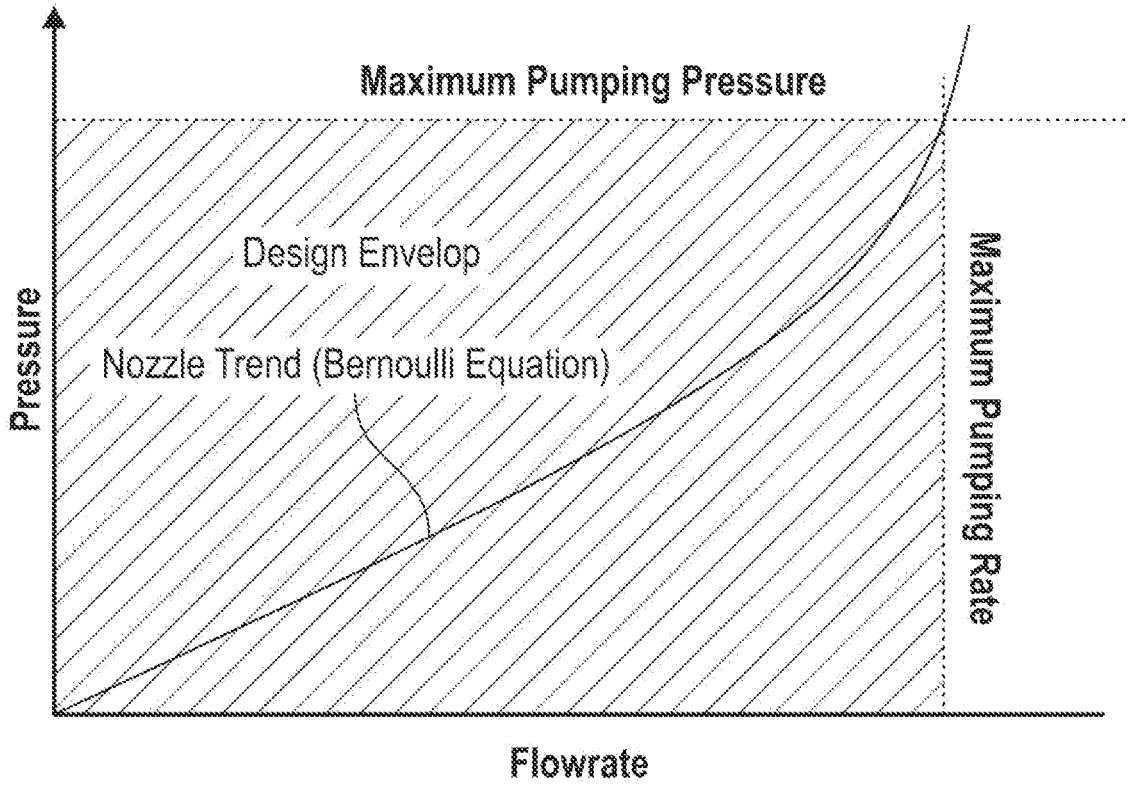
FIG. 5 is a plot of flow rate as a function of supply pressure used to design a self-resonating nozzle for outputting a jet of fluid for creating channels in a hydrocarbon-bearing subterranean formation.

Bernoulli equation can be employed to estimate the velocity required to overcome the local head loss and the differential pressure between the resonant cavity and the wellbore annulus space. The flowrate required to cause resonance in the resonant cavity can be calculated from the jetting velocity. The estimated flowrate can be determined from a wellbore simulator that simulates the tubing and wellbore conditions to predict the maximum circulation pressure. Then the total pressure can be compared with the pump ratings to determine a pump for use in the operations. FIG. 5 is a plot of flow rate as a function of supply pressure used to design a self-resonating nozzle for outputting a jet of fluid for creating channels (e.g., notches or perforations) in a hydrocarbon-bearing subterranean formation.

In embodiments, the geometry and dimensions of the resonant cavity and the nozzle orifice of the self-resonating nozzle can be configured to support resonance of aqueous fluid or other non-abrasive fluid supplied under pressure to the self-resonating nozzle.

In yet other embodiments, the geometry and dimensions of the resonant cavity and the nozzle orifice of the self-resonating nozzle can be configured as an organ pipe resonator, a Helmholtz resonator or other suitable resonator.

Figure 6A:
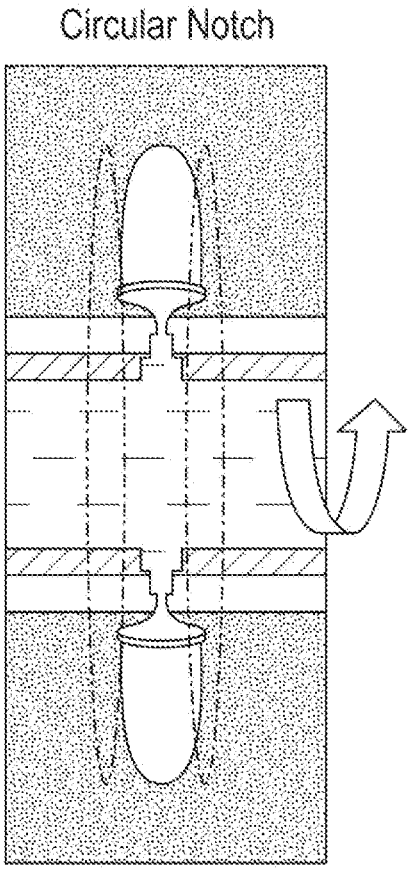
FIGS. 6A and 6B are schematic diagrams that illustrate use of a self-resonating nozzle that outputs a jet of fluid for creating circular notches and perforations, respectively, in a hydrocarbon-bearing subterranean formation.
Figure 6B:
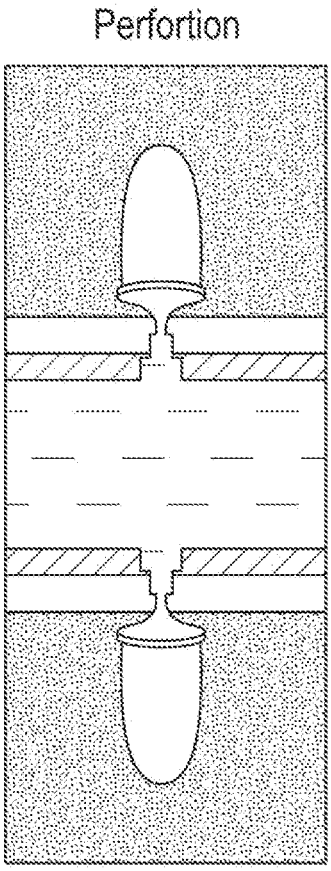

FIGS. 6A and 6B are schematic diagrams that illustrate use of one or more self-resonating nozzles that output a jet of fluid for creating 360° (i.e., circular) notches and discrete perforations, respectively, in a hydrocarbon-bearing subterranean formation. The weak point can be a perforation in the open hole wall, or a longitudinally or transversely cut notch in the open hole wall, including a 360° "circular" notch cut along the complete circumference of the open hole wall. At such a weak point, a fracture has a preference to initiate and propagate at lower pressure due to the high tensile stress concentrations developed in desired directions. In this manner, the creation of the weak point in the formation allows for the fracture breakdown pressure to be reduced for subsequent fracture stimulation of the formation. The perforation or notch can extend in a radial direction into the formation away from the central axis of the wellbore.

If a 360° notch is desired, one or more self-resonating nozzles can be supported on a rotatable downhole tool that is deployed in a horizontal interval of a wellbore and rotated about the wellbore axis as the pressurized fluid is supplied to the self-resonating nozzle(s). Such rotation can form a 360° notch in the hydrocarbon-bearing subterranean formation as shown in FIG. 6A. The required location and depth of penetration to the rock for the 360° notch can be determined in the fracture design stage. Alternatively, if discrete perforation is desired, one or more self-resonating nozzles can be supported on the BHA of a downhole tool (or integrated as part of the liner or completion equipment) that is positioned in a stable location and orientation in the horizontal interval of a wellbore as the pressurized fluid is supplied to the self-resonating nozzle(s). Such operations can form one or more discrete perforations in the hydrocarbon-bearing subterranean formation adjacent the self-resonating nozzle(s). The perforation forms a tunnel in the formation as shown in FIG. 6B. The required locations and penetration depths of the perforations can be determined in the fracture design stage for the job.

In other embodiments, if a linear (or longitudinal) notch is desired, one or more self-resonating nozzles can be supported on a moveable downhole tool that is deployed in a horizontal interval of a wellbore and moved linearly (or longitudinally) along the wellbore axis as the pressurized fluid is supplied to the self-resonating nozzle(s). Such manipulation of the tool can form one or more linear (or longitudinal) notches in the hydrocarbon-bearing subterranean formation.

In still other embodiments, if a curvilinear or more complex notch is desired, one or more self-resonating nozzles can be supported on a moveable/rotatable downhole tool that is deployed in a horizontal interval of a wellbore and moved with a combination linear (or longitudinal) and rotational movements as the pressurized fluid is supplied to the self-resonating nozzle(s). Such manipulation of the tool can form one or more curvilinear or more complex notches in the hydrocarbon-bearing subterranean formation.

In the embodiments described herein, a fracture stimulation treatment can be performed after the creation of the channel(s) (e.g., perforation(s) or notch(es)) by water jetting or hydro demolition. The fracture stimulation treatment injects fluid, which is typically referred to as "frac fluid," under high pressure into the formation to break the formation rock and create fractures in the rock that are fluidly coupled to the wellbore. In such embodiments, the channels (e.g., perforation(s) or notch(es)) formed by water jetting or hydro demolition function as a weak point in the formation rock where the fractures have a preference to initiate and propagate at lower pressure due to the high tensile stress concentrations developed in desired directions. Thus, the fracture stimulation treatment creates fractures that initiate and propagate from the channels(s) (e.g., perforation(s) or notch(es)) formed by water jetting or hydro demolition. Furthermore, the creation of the channels(s) (e.g., perforation(s) or notch(es)) in the formation allows for the fracture breakdown pressure to be reduced for the subsequent fracture stimulation treatment of the formation.

Figure 7:
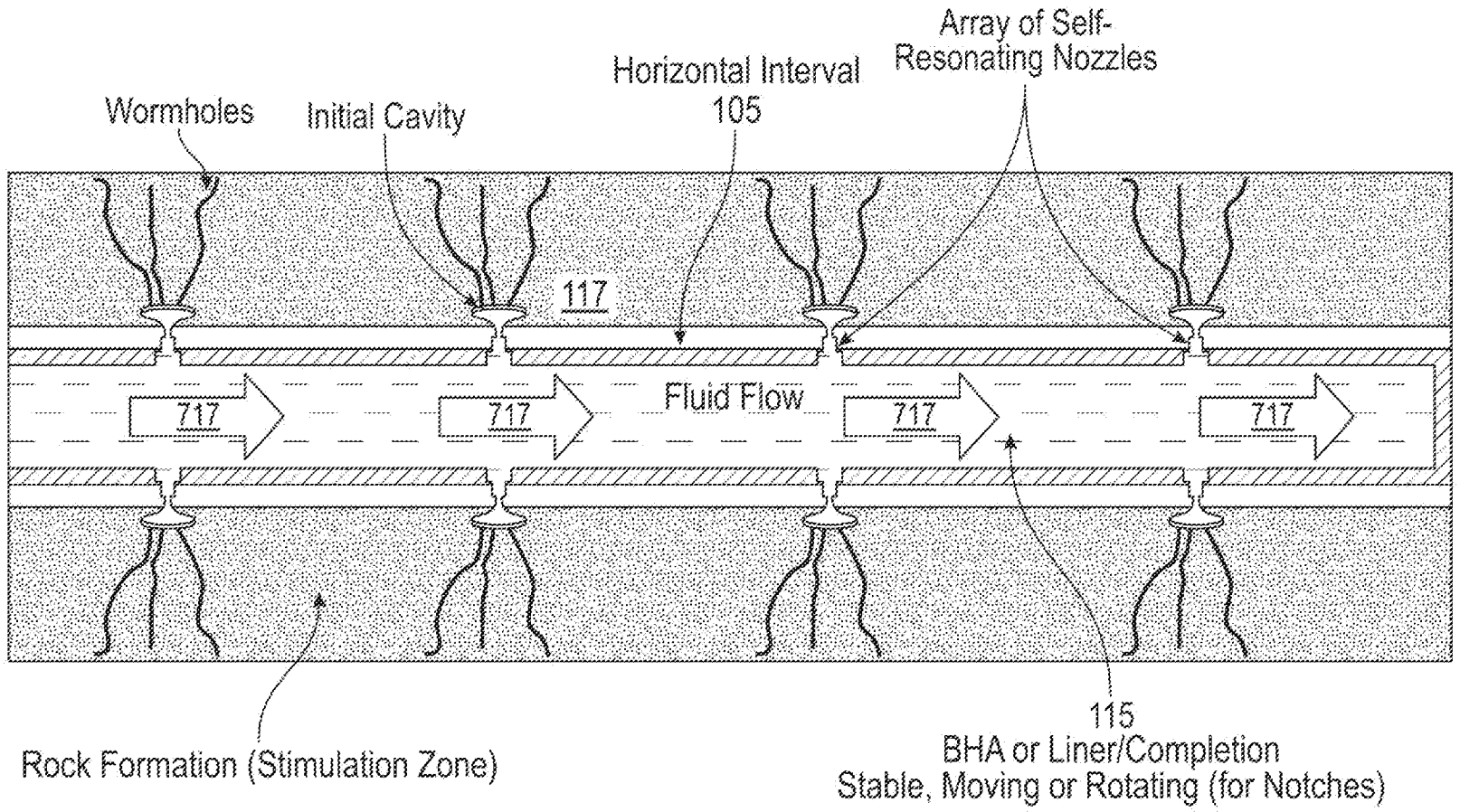
FIG. 7 is a schematic diagram of an illustrative downhole tool for creating channels (e.g., wormholes) in a hydrocarbon-bearing subterranean formation by acid jetting.

In other embodiments, an array of self-resonating nozzles can be supported on the housing of a downhole tool or liner (e.g., slotted liner completion, a screen and liner completions, or other non-cemented completion) or multistage completion equipment that completes a horizontal interval 105 (FIG. 7). During operations, fluid is pumped from the surface down tubing under high pressure (below fracturing pressure) for supply to the array of self-resonating nozzles in a manner similar to the embodiment of FIG. 1 to create j ets of fluid that dissolve rock of the subterranean formation 107 in the near wellbore region to create channels or wormholes in the formation 107. Such operations are referred to herein as "acid jetting."

In one embodiment illustrated in FIG. 7, the BHA 115 is deployed in the horizontal interval 105 of the wellbore. The BHA 115 (or possibly liner/completion equipment) has a central channel that is in fluid communication with the interior tubular channel of tubing that extends from the surface. During operations, fluid is pumped from the surface down the tubing under high pressure for supply to the array of self-resonating nozzles as noted by arrows 717. In embodiments, the fluid can be a specially-designed or selected chemical composition (e.g., an acid) that reacts with the formation rock to dissolve the formation rock. Each self-resonating nozzle of the array includes a resonant cavity formed upstream of a nozzle orifice. The pressurized fluid flows from the central channel of the BHA 115 (or liner) into the resonant cavity of each self-resonating nozzle. The dimensions and geometry of the resonant cavity and nozzle orifice for each nozzle are configured to provide internal self-excited resonant oscillation of acoustic waves of specific frequencies formed by the flow of the fluid through the resonant cavity and out the nozzle orifice. The self-excited resonant oscillation of the fluid produces jets of oscillating fluid velocity that is output from the nozzle orifices. The oscillating fluid velocity of the jets forms high frequency pressure pulses that impact the surfaces of the subterranean formation 107 that face the nozzle orifices and lead to efficient and effective dissolving of formation rock to form channels (e.g., wormholes) that penetrate into the formation. The dissolution of the formation rock may initially form a cavity at the wellbore surface of the formation and continues to form dominant channels or wormholes that extend from the rock surface or the initial cavity and penetrate into the formation as shown.

Figure 8:
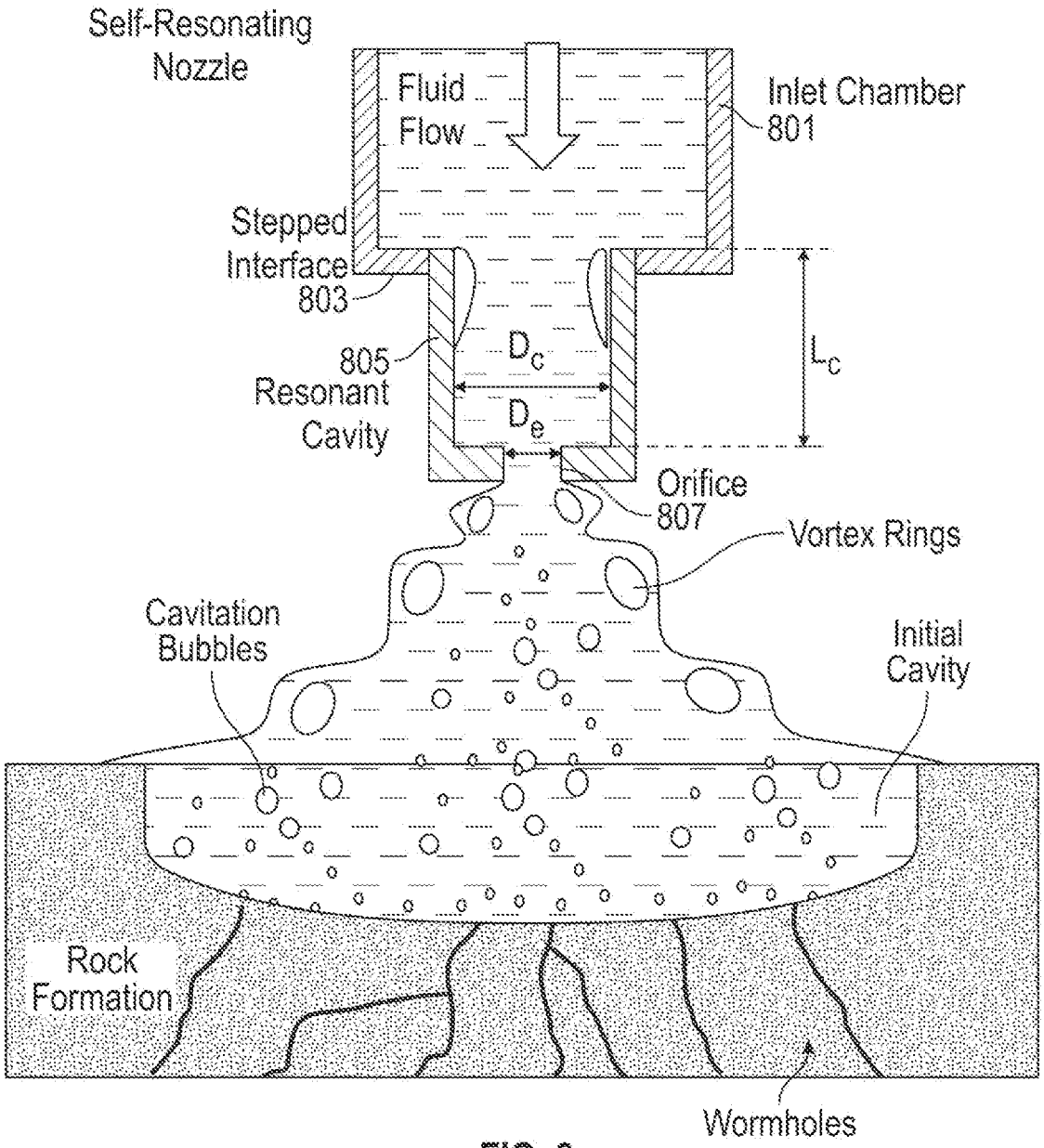
FIG. 8 is a schematic diagram of an example self-resonating nozzle that is part of the downhole tool of FIG. 7 and configured to output a jet of fluid for creating channels (e.g., wormholes) in a hydrocarbon-bearing subterranean formation by acid jetting.

FIG. 8 illustrates an embodiment of a self-resonating nozzle as described herein. In this embodiment, the self-resonating nozzle includes an inlet chamber (cavity) 801, which can be in fluid communication with the central channel of the BHA 115 or a liner/completion equipment for receiving a pressurized flow of fluid as shown. The fluid can be a specially-designed or selected chemical composition (e.g., an acid) that reacts with the formation rock to dissolve the formation rock. The inlet chamber 801 extends through the self-resonating nozzle to a stepped interface (with reduced cross-sectional area) 803 that leads to a resonant cavity 805 disposed upstream of a nozzle orifice 807. The dimensions and geometry of the resonant cavity 805 and the nozzle orifice 807 are configured to provide internal self-excited resonant oscillation of acoustic waves of specific frequencies formed by the flow of the fluid through the resonant cavity 805 and out the nozzle orifice 807. The self-excited resonant oscillation of the fluid produces jets of oscillating fluid velocity that is output from the nozzle orifices. The oscillating fluid velocity of the jets forms high frequency pressure pulses that lead to efficient and effective dissolving of the formation rock to form channels or wormholes that penetrate into the formation. The dissolution of the formation rock initially forms a cavity at the wellbore surface of the formation and continues to form dominant channels or wormholes that extend from the rock surface or from the initial cavity and penetrate into the formation.

As the fluid flows through the nozzle orifice 807 of the self-resonating nozzle, bubbles of the fluid vapor form. As these bubbles exit the nozzle orifice 807, they expand causing pressure magnification and fluctuation. When the bubbles reach the target surface of the formation, they may collapse causing an acoustic pressure wave that is fed back to the nozzle. When the dimensions and geometry of the resonant cavity 805 and the nozzle orifice 807 are tuned to a fundamental/natural frequency, the nozzle starts resonating to produce internal self-excited resonant oscillation of acoustic waves of specific frequencies formed by the flow of the fluid through the resonant cavity 805 and out the nozzle orifice 807.

The oscillating fluid velocity of the jet output by the self-resonating nozzle of FIG. 8 can be similar to that shown in FIG. 4. The oscillating fluid velocity of the jet forms high frequency pressure pulses that lead to efficient and effective dissolving of the formation rock to form channels of wormholes that penetrate into the formation. The dissolution of the formation rock may initially form a cavity at the wellbore surface of the formation and continues to form one or more channels or wormholes that extend from the initial cavity and penetrate into the formation.

The resonance of the self-resonating nozzle is activated by controlling the pumping parameters (pressure and flowrate) according to the dimensions and geometry of the resonant cavity and the nozzle orifice as described herein.

In yet other embodiments, the geometry and dimensions of the resonant cavity and the nozzle orifice of the self-resonating nozzle can be configured as an organ pipe resonator, a Helmholtz resonator or other suitable resonator.

In embodiments, one or more self-resonating nozzles can be configured to output a jet of fluid for creating channels or wormholes in a hydrocarbon-bearing subterranean formation similar to the water jetting configuration of FIG. 6B. In this configuration, the one or more self-resonating nozzles can be supported on the BHA of a downhole tool (or integrated as part of the liner or completion equipment) that is positioned in a stable location and orientation in the horizontal interval of a wellbore as the pressurized fluid is supplied to the self-resonating nozzle(s). Such operations can form channels or wormholes in the hydrocarbon-bearing subterranean formation by dissolution of formation rock. The dissolution of the formation rock initially forms a cavity at the wellbore surface of the formation and continues to form one or more channels or wormholes that extend from the initial cavity and penetrate into the formation (FIG. 8). The required locations and penetration depths of the initial cavities and wormholes can be determined in the design stage for the job. In embodiments, the wormholes that penetrate into the formation provide tunnels in the formation that are fluidly coupled to the wellbore. The path of the wormhole(s) into the formation can be dependent on the localized solubility of the formation rock in the fluid of the jet and other parameters. The one or more wormholes can provide for fluid communication between the wellbore and the subterranean formation that holds formation fluid trapped in the formation.

Figure 9:
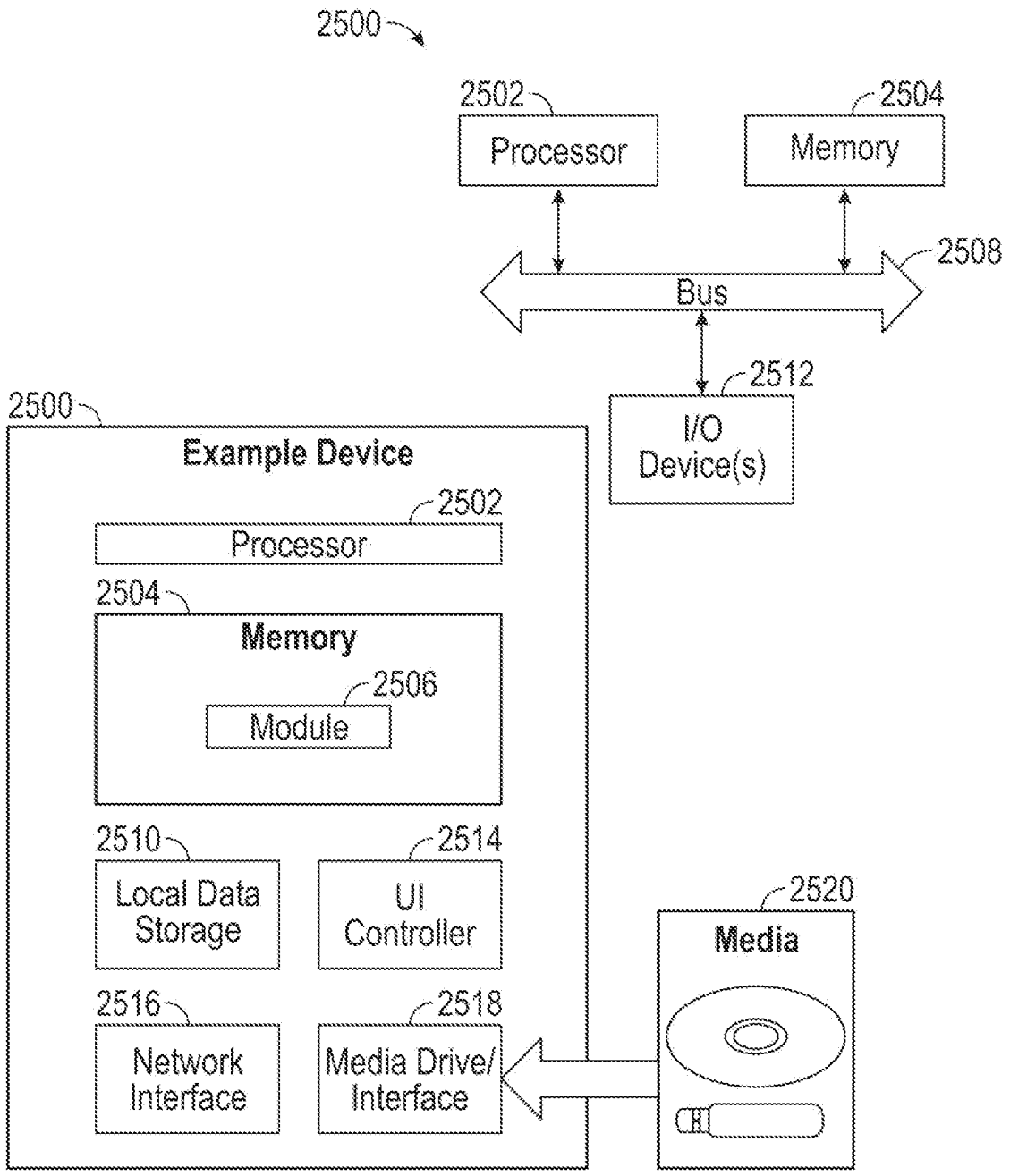
FIG. 9 illustrates a schematic view of a computing system according to an embodiment of the present disclosure.

FIG. 9 illustrates an example device 2500, with a processor 2502 and memory 2504 that can be configured to implement various embodiments of the methods and processes as discussed in the present application. For example, the configuration and design of the self-resonating nozzles and system as well as the operating parameters for the stimulating operations/workflow can employ computer program instructions (software) that execute on the device 2500. Memory 2504 can also host one or more databases and can include one or more forms of volatile data storage media such as random-access memory (RAM), and/or one or more forms of nonvolatile storage media (such as read-only memory (ROM), flash memory, and so forth).

Device 2500 is one example of a computing device or programmable device and is not intended to suggest any limitation as to scope of use or functionality of device 2500 and/or its possible architectures. For example, device 2500 can comprise one or more computing devices, programmable logic controllers (PLCs), etc.

Further, device 2500 should not be interpreted as having any dependency relating to one or a combination of components illustrated in device 2500. For example, device 2500 may include one or more of computers, such as a laptop computer, a desktop computer, a mainframe computer, etc., or any combination or accumulation thereof.

Device 2500 can also include a bus 2508 configured to allow various components and devices, such as processors 2502, memory 2504, and local data storage 2510, among other components, to communicate with each other.

Bus 2508 can include one or more of any of several types of bus structures, including a memory bus or memory controller, a peripheral bus, an accelerated graphics port, and a processor or local bus using any of a variety of bus architectures. Bus 2508 can also include wired and/or wireless buses.

Local data storage 2510 can include fixed media (e.g., RAM, ROM, a fixed hard drive, etc.) as well as removable media (e.g., a flash memory drive, a removable hard drive, optical disks, magnetic disks, and so forth). One or more input/output (I/O) device(s) 2512 may also communicate via a user interface (UI) controller 2514, which may connect with I/O device(s) 2512 either directly or through bus 2508.

In one possible implementation, a network interface 2516 may communicate outside of device 2500 via a connected network. A media drive/interface 2518 can accept removable tangible media 2520, such as flash drives, optical disks, removable hard drives, software products, etc. In one possible implementation, logic, computing instructions, and/or software programs comprising elements of module 2506 may reside on removable media 2520 readable by media drive/interface 2518.

In one possible embodiment, input/output device(s) 2512 can allow a user (such as a human annotator) to enter commands and information to device 2500, and also allow information to be presented to the user and/or other components or devices. Examples of input device(s) 2512 include, for example, sensors, a keyboard, a cursor control device (e.g., a mouse), a microphone, a scanner, and any other input devices known in the art. Examples of output devices include a display device (e.g., a monitor or projector), speakers, a printer, a network card, and so on.

Various systems and processes of present disclosure may be described herein in the general context of software or program modules, or the techniques and modules may be implemented in pure computing hardware. Software generally includes routines, programs, objects, components, data structures, and so forth that perform particular tasks or implement particular abstract data types. An implementation of these modules and techniques may be stored on or transmitted across some form of tangible computer-readable media. Computer-readable media can be any available data storage medium or media that is tangible and can be accessed by a computing device. Computer readable media may thus comprise computer storage media. "Computer storage media" designates tangible media, and includes volatile and non-volatile, removable, and non-removable tangible media implemented for storage of information such as computer readable instructions, data structures, program modules, or other data. Computer storage media include, but are not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other tangible medium which can be used to store the desired information, and which can be accessed by a computer.

Some of the methods and processes described above, can be performed by a processor. The term "processor" should not be construed to limit the embodiments disclosed herein to any particular device type or system. The processor may include a computer system. The computer system may also include a computer processor (e.g., a microprocessor, microcontroller, digital signal processor, general-purpose computer, special-purpose machine, virtual machine, software container, or appliance) for executing any of the methods and processes described above.

The computer system may further include a memory such as a semiconductor memory device (e.g., a RAM, ROM, PROM, EEPROM, or Flash-Programmable RAM), a magnetic memory device (e.g., a diskette or fixed disk), an optical memory device (e.g., a CD-ROM), a PC card (e.g., PCMCIA card), or other memory device.

Alternatively or additionally, the processor may include discrete electronic components coupled to a printed circuit board, integrated circuitry (e.g., Application Specific Integrated Circuits (ASIC)), and/or programmable logic devices (e.g., a Field Programmable Gate Arrays (FPGA)). Any of the methods and processes described above can be implemented using such logic devices.

Some of the methods and processes described above, can be implemented as computer program logic for use with the computer processor. The computer program logic may be embodied in various forms, including a source code form or a computer executable form. Source code may include a series of computer program instructions in a variety of programming languages (e.g., an object code, an assembly language, or a high-level language such as C, C++, or JAVA). Such computer instructions can be stored in a non-transitory computer readable medium (e.g., memory) and executed by the computer processor. The computer instructions may be distributed in any form as a removable storage medium with accompanying printed or electronic documentation (e.g., shrink wrapped software), preloaded with a computer system (e.g., on system ROM or fixed disk), or distributed from a server or electronic bulletin board over a communication system (e.g., the Internet or World Wide Web).

Although only a few example embodiments have been described in detail above, those skilled in the art will readily appreciate that many modifications are possible in the example embodiments without materially departing from this invention. For example, the methods and systems as described herein can be deployed and used in vertical wellbores and other wellbores that traverse a subterranean formation. In yet other embodiments, other fluids different from the aqueous fluid described herein can be supplied under pressure to the self-resonating nozzles of the system to create the perforations or notches in the subterranean formation.

Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A method for stimulating recovery of hydrocarbons from a subterranean formation traversed by a wellbore, comprising:

deploying equipment in the wellbore, wherein the equipment includes at least one self-resonating nozzle; and supplying fluid under pressure to the at least one self-resonating nozzle to create a channel in a surface of the subterranean formation facing the at least one self-resonating nozzle, wherein the fluid comprises a chemical composition that dissolves the subterranean formation.

2. The method of claim 1, wherein:

the equipment comprises a downhole tool that is deployed in the wellbore.

3. The method of claim 1, wherein:

the equipment comprises completion equipment that is deployed in the wellbore.

4. The method of claim 1, wherein:

the at least one self-resonating nozzle includes a resonant cavity formed upstream of a nozzle orifice, wherein the fluid under pressure is configured to flow into the resonant cavity of the at least one self-resonating nozzle.

5. The method of claim 4, wherein:

dimensions and geometry of the resonant cavity and the nozzle orifice are configured to provide internal self-excited resonant oscillation of acoustic waves of specific frequencies formed by fluid flow through the resonant cavity and out the nozzle orifice.

6. The method of claim 5, wherein:

the self-excited resonant oscillation produces a jet of oscillating fluid velocity that is output from the nozzle orifice, wherein the oscillating fluid velocity of the jet forms high frequency pressure pulses that impact a surface of the subterranean formation that faces the nozzle orifice to create the channel.

7. The method of claim 6, wherein:

the high frequency pressure pulses of the jet create the channel in the subterranean formation by dissolving formation rock.

8. The method of claim 7, wherein:

the channel comprises a wormhole that penetrates into the subterranean formation.

9. The method of claim 1, wherein:

the equipment includes an array of self-resonating nozzles configured to create channels in surfaces of the subterranean formation facing the array of self-resonating nozzles.

10. The method of claim 1, wherein:

the at least one self-resonating nozzle is supported on the equipment that is positioned in a stable location and orientation in the wellbore as the pressurized fluid is supplied to the at least one self-resonating nozzle to create the channel in the subterranean formation.

11. Equipment that is deployable in a wellbore that traverses a subterranean formation, the equipment for stimulating recovery of hydrocarbons from the subterranean formation, the equipment comprising:

at least one self-resonating nozzle configured to receive fluid under pressure and create a channel in a surface of the subterranean formation facing the at least one self-resonating nozzle wherein the fluid comprises a chemical composition that dissolves the subterranean formation.

12. The equipment of claim 11, which comprises a downhole tool that is deployed in the wellbore.

13. The equipment of claim 11, which comprises completion equipment that is deployed in the wellbore.

14. The equipment of claim 11, wherein:

the at least one self-resonating nozzle includes a resonant cavity formed upstream of a nozzle orifice, wherein the fluid under pressure is configured to flow into the resonant cavity of the at least one self-resonating nozzle.

15. The equipment of claim 14, wherein:

dimensions and geometry of the resonant cavity and the nozzle orifice are configured to provide internal self-excited resonant oscillation of acoustic waves of specific frequencies formed by fluid flow through the resonant cavity and out the nozzle orifice.

16. The equipment of claim 15, wherein:

the self-excited resonant oscillation produces a jet of oscillating fluid velocity that is output from the nozzle orifice, wherein the oscillating fluid velocity of the jet forms high frequency pressure pulses that provide a momentum to the surface of the subterranean formation that faces the nozzle orifice to create the channel in the subterranean formation.

17. The equipment of claim 11, which comprises an array of self-resonating nozzles configured to create channels in surfaces of the subterranean formation facing the array of self-resonating nozzles.

18. The equipment of claim 16, wherein:

the high frequency pressure pulses of the jet create the channel in the subterranean formation by dissolving formation rock to form a wormhole that penetrates into the subterranean formation.

19. A method for stimulating recovery of hydrocarbons from a subterranean formation traversed by a wellbore, comprising:

deploying equipment in the wellbore, wherein the equipment includes at least one self-resonating nozzle;

supplying fluid under pressure to the at least one self-resonating nozzle to create a channel in a surface of the subterranean formation facing the at least one self-resonating nozzle; and performing a fracture stimulation treatment after creation of the channel, wherein the fracture stimulation treatment injects fluid under high pressure into the formation to break formation rock and create fractures in the rock that are fluidly coupled to the wellbore, wherein the fractures initiate and propagate from the channel.

20. The method of claim 19, wherein:

the fluid comprises aqueous fluid.

21. The method of claim 20, wherein:

the aqueous fluid comprises ground water, water extracted from a river or lake or other body of water, seawater or brackish water, output of a desalinization plant, or other water-based fluid.

22. The method of claim 20, wherein:

the aqueous fluid is filtered.

23. The method of claim 19, wherein:

the at least one self-resonating nozzle includes a resonant cavity formed upstream of a nozzle orifice, wherein the fluid under pressure is configured to flow into the resonant cavity of the at least one self-resonating nozzle.

24. The method of claim 23, wherein:

dimensions and geometry of the resonant cavity and the nozzle orifice are configured to provide internal self-excited resonant oscillation of acoustic waves of specific frequencies formed by fluid flow through the resonant cavity and out the nozzle orifice.

25. The method of claim 24, wherein:

the self-excited resonant oscillation produces a jet of oscillating fluid velocity that is output from the nozzle orifice, wherein the oscillating fluid velocity of the jet forms high frequency pressure pulses that impact the surface of the subterranean formation that faces the nozzle orifice to create the channel.

26. The method of claim 25, wherein:

the fluid comprises aqueous fluid;

the high frequency pressure pulses of the jet create the channel in the subterranean formation by erosion or hydro demolition; and the channel comprises a perforation or notch in the subterranean formation.

27. The method of claim 19, wherein:

the equipment comprises a downhole tool that is deployed in the wellbore.

28. The method of claim 19, wherein:

the equipment comprises completion equipment that is deployed in the wellbore.

29. The method of claim 19, wherein:

the at least one self-resonating nozzle is supported on a rotatable downhole tool that is deployed in the wellbore and rotated about the wellbore axis as the pressurized fluid is supplied to the at least one self-resonating nozzle to create a circular notch in the subterranean formation.

* * * * *